US006349556B1

(12) United States Patent
Barnett et al.

(10) Patent No.: US 6,349,556 B1
(45) Date of Patent: Feb. 26, 2002

(54) WATER TANK FOR ICE MAKING MACHINE

(75) Inventors: Mark Barnett, Sharpsburg; Glenn O'Neal Melton, Fayetteville; Kazuhiro Yoshida, Peachtree City, all of GA (US)

(73) Assignee: Hoshizaki America, Inc., Peachtree City, GA (US)

( * ) Notice: Subject to any disclaimer, the term of this patent is extended or adjusted under 35 U.S.C. 154(b) by 0 days.

(21) Appl. No.: 09/731,713

(22) Filed: Dec. 8, 2000

(51) Int. Cl.[7] ..... F25C 1/12
(52) U.S. Cl. ..... 62/340; 62/347
(58) Field of Search ..... 62/66, 74, 340, 62/347

(56) References Cited

U.S. PATENT DOCUMENTS

| | | | |
|---|---|---|---|
| 2,691,275 | A | 10/1954 | Andrews |
| 3,913,349 | A | 10/1975 | Johnson |
| 4,341,087 | A | 7/1982 | Vansteenburgh, Jr. |
| 4,363,220 | A | 12/1982 | Ripley |
| 4,366,679 | A | 1/1983 | Vansteenburgh, Jr. |
| 4,459,824 | A | 7/1984 | Krueger |
| 4,589,261 | A | 5/1986 | Ohashi et al. |
| 4,706,466 | A | 11/1987 | Yingst et al. |
| 4,722,199 | A | 2/1988 | Hibino |
| 4,893,478 | A | 1/1990 | Kruck et al |
| 4,917,256 | A | 4/1990 | Kruck et al. |
| 4,920,764 | A | 5/1990 | Martin |
| 5,182,925 | A | 2/1993 | Alvarez et al. |
| 5,237,837 | A | 8/1993 | Naruse et al. |
| 5,291,752 | A | 3/1994 | Alvarez et al. |
| 5,345,782 | A | 9/1994 | Takahashi et al. |
| 5,722,244 | A | 3/1998 | Shelton |
| 5,803,561 | A | 9/1998 | Puehlhorn |
| 5,878,583 | A | 3/1999 | Schlosser et al. |
| 6,112,533 | A | 9/2000 | Kato et al. |
| 6,122,927 | A | 9/2000 | Moore |

*Primary Examiner*—William E. Tapolcai
(74) *Attorney, Agent, or Firm*—Arent Fox Kintner Plotkin & Kahn, PLLC

(57) ABSTRACT

A water tank including a frusto-conical support hat portion and a tub portion. The tub portion having a support mound that includes a first section and a second section extending from the first section. The first section has a width larger than a width of the second section such that a ledge is formed between the first and second sections. The second section has a rectangular aperture formed therein that permits the manufactured ice to pass therethrough. The support hat portion has a support mound that has a width no larger than the width of the first section. An integral support system includes the support hat nestingly engaging the tub portion from a bottom portion of the tub portion to provide a central support for an ice guide placed on the water tank.

11 Claims, 11 Drawing Sheets

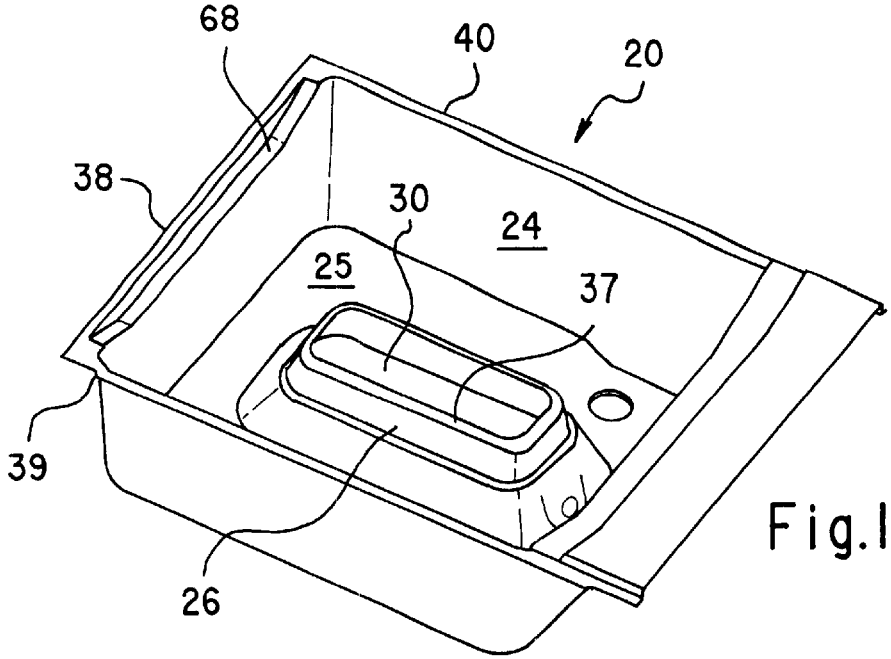
Fig.10
Fig.11
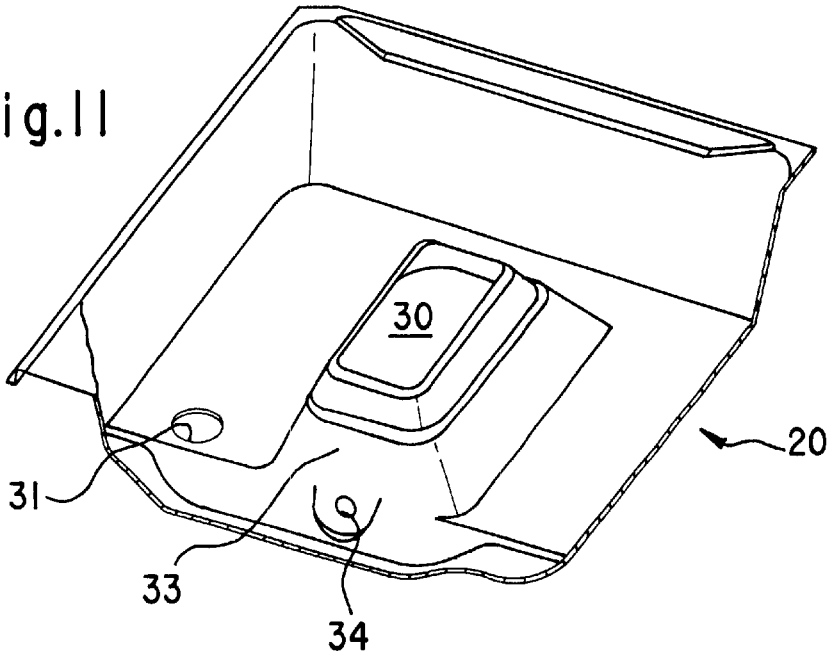

WATER TANK FOR ICE MAKING MACHINE

BACKGROUND OF THE INVENTION

1. Field of the Invention

This invention relates to an improved water tank for an ice making machine having an integral support system to alleviate stress on an ice cube guide placed on the water tank and provides a center chute for ice to flow through and fall into a bin positioned below.

2. Description of Related Art

It is well known in the art that there are essentially two types of ice making machines, household units and self-contained commercial units. The household units are typically combined with refrigerators commonly located in the kitchen of a house or office. The household units manufacture relatively small batches of ice by using cool air to freeze water in a tray located in the freezer section of the refrigerator.

The self-contained commercial units are most frequently used in hotels, restaurants, taverns, hospitals, as well as any other establishment regularly requiring relatively large batches of ice to be provided for customers. It should be noted the self-contained commercial units can be further separated into one of two categories depending upon the type of ice they manufacture, namely flaked and cubed. The self-contained commercial units can manufacture ice in several well known ways.

For example, a steady stream of water is either circulated over or dripped onto a chilled ice mold, which deposits several thin layers of ice in pockets of the mold, resulting in ice cubes. Other self-contained commercial units circulate the steady stream of water over ice making plates. The plates can be flat, grid-shaped, or any other configuration necessary to accommodate the specific shape desired. Evaporator tubes are attached to the back of the ice making plates to change the flowing water to ice via heat exchange. The ice making plates are known to be designed to have single or dual-sided rows of ice.

Water that does not freeze after being circulated over the chilled ice mold or ice making plates is collected in a water tank located beneath the ice making assembly. The collected water is recirculated over the chilled mold or ice making plates until the water is cool enough to freeze. Normally, the making machine is designed to stop ice production when the formed ice has reached a predetermined size. Then, when the ice making machine has determined that the chilled ice mold or ice making plate is substantially full of ice, the formed ice is harvested from the mold or plates. The harvested ice is typically stored in an insulated, but unrefrigerated, bin. The bin is insulated to keep the ice cool but is unrefrigerated so the ice may melt slowly, thereby preventing the ice from sticking together.

The ice making mold or plates are chilled because of their proximity to the evaporator of a standard refrigeration circuit. Typically, refrigerant gas is compressed within closed tubes of a refrigeration circuit. A compressor, driven by an electric motor, compresses the refrigerant to a high pressure and supplies the compressed refrigerant to a condenser. The condenser then cools the compressed refrigerant using air or water blown across tubes by a fan.

The compressed refrigerant is then passed through an expansion valve, which considerably drops the pressure of the refrigerant, thereby cooling the refrigerant. Tubes holding the expanded, cooled refrigerant are attached, usually by welding, to the back of an evaporator plate. The evaporator plate is typically made of copper and is attached to a lattice-like structure of evaporator tubes, also made of copper, used to mold the ice into cubes. The lattice-like structure and evaporator plate form the mold or plate and, together with the copper tubing, are known as the evaporator.

The ice is harvested by passing hot compressed air into the evaporator so the ice mold or plate is warmed and the ice slightly thaws. Typically, the mold or plate is positioned so gravity pulls the semi-thawed ice off the mold or plate and into the ice storage bin. The storage bin includes an ice level sensor so the ice making machine halts ice production if the bin is storing a predetermined amount of ice.

An electronic controller, such as for example only, a microprocessor, controls the process to activate the operating parts like the fans, motors, pumps, and valves that control the functioning of the ice maker. The ice level sensor provided in the storage bin is also controlled by the microprocessor.

Commercial self-contained ice makers are required to continuously and reliably produce relatively large amounts of ice. Furthermore, since the self-contained ice makers are primarily used in the service industries, i.e., hotels, restaurants, and the like, when an ice maker breaks down or produces an insufficient amount of ice, service is disrupted. However, because ice is a fungible good and provides very little if any profit, users typically do not seek better ice, but rather less costly ice made from a reliable and cost efficient ice maker that is easy to assemble and maintain.

Accordingly, low-cost operation requires an ice maker be nearly maintenance-free because down-time for maintenance costs money as someone must be paid to service the machine. Furthermore, such low-cost operation and maintenance must extend over many years, as ice makers are relied upon to manufacture ice over a long period of time.

Another problem faced by many ice making machines is corrosion. Because ice making machine housings are typically made of metal, corrosion occurs from the water splashing about the interior of the machine due to the water dripping onto the mold, as well as when ice is released for harvesting. Also, manufacturing an ice making machine having a structure that deals with the splashing water without leaking usually involves seals having various types of fasteners to make the machine water-tight. Therefore, because there is a large number of parts needed to provide a watertight seal, assembling such ice making machines is generally complicated.

Yet another problem ice making machines face is the difficulty of servicing and maintenance. Preferably, the refrigeration components and the control electronics should be isolated from the splashing water and humidity of the ice maker, yet still allow easy access for repair. In other words, ice making machines must be able to insulate the cold areas and wet areas from the dry and warm areas.

In particular, the ice making section has to accommodate water circulation, ice molds or ice making plates, water tanks, pumps, and evaporators. To be efficient, the ice making section must also be water-tight, insulated, and simple to clean and maintain. Some existing designs have roto-molded sections made for the entire ice making section. Although this design meets the above-described design criteria, there is the drawback that there must be a specific mold for each size ice making machine, which increases factory time and manufacturing costs.

Ice guides move the formed ice along a predetermined path from the ice making plate to the ice storage bin. The ice guide must withstand the dropping force of the ice as well as permit the splashing and dripped water to flow to the water tank below so as to be recirculated. Some known ice guide designs provide a chute that directs the water into a small tank to be pumped. Other ice guide designs also have the chute going to a particular area. Furthermore, the ice guide should be designed so none of the manufactured ice becomes stuck, which can lead to bridging and malfunction of the ice making machine, thereby necessitating maintenance if not repair costs.

Furthermore, it should be noted that the water tank is not only used to store water in the ice machine, but also acts as a level guide for ice inlet and as a checkpoint for ice production. Some existing water tank designs also have level switches to gauge when to turn the water valve on and off based on the level of the water therein. However, because of the additional components needed to provide these other functions, the water tanks are very difficult to clean and maintain when trying to remove build-up of scale, lime, or other such residue that results from the water being circulated therethrough. Yet other existing water tank designs are thin and rather narrow when compared to the evaporator section positioned above the water tank. In other words, the width of such water tanks are smaller than the width of the evaporator section. Such a configuration tends to make the water tank difficult to reach for cleaning, repair, maintenance, and the like.

SUMMARY OF THE INVENTION

Accordingly, it is an object of this invention is to provide a water tank that overcomes the above-described deficiencies of the related art.

Another object of this invention is to simplify the design of the water tank for a commercial self-contained ice making machine. The tank is also usable as the base of the ice manufacturing portion of the machine and has a receiving area large enough to service multiple evaporators simultaneously. Furthermore, the structure of the water tank eliminates the need for a separate part for the tank, ice guide chute, and base of the ice making section to be set on top of the ice bin.

It is yet another object of this invention to provide a water tank that fully utilizes the space the water tank occupies, minimizes the number of parts and is manufactured from molds that can be easily adapted to many types of ice making machines. Various step portions in the water tank provide added support and strength to any ice guide used with the tank, resulting in a water tank with a stiffer design than existing tanks, thereby making the water tank more resistant to wear and tear. The relatively larger water tank and step portions provided thereon facilitate ease of cleaning, as well as for maintenance. The configuration of the water tank allows for the addition of more evaporators as well as simplifies replacement.

BRIEF DESCRIPTION OF THE DRAWINGS

These and other objects and advantages of this invention will become more fully apparent from the following detailed description when read in conjunction with the accompanying drawings with like reference numerals indicating corresponding parts throughout, wherein:

FIG. 10 is a perspective view of the tub portion of the water tank;

FIG. 11 is a bottom view of the tub portion illustrated in FIG. 10;

DETAILED DESCRIPTION OF THE PREFERRED EMBODIMENT

Figure 1:
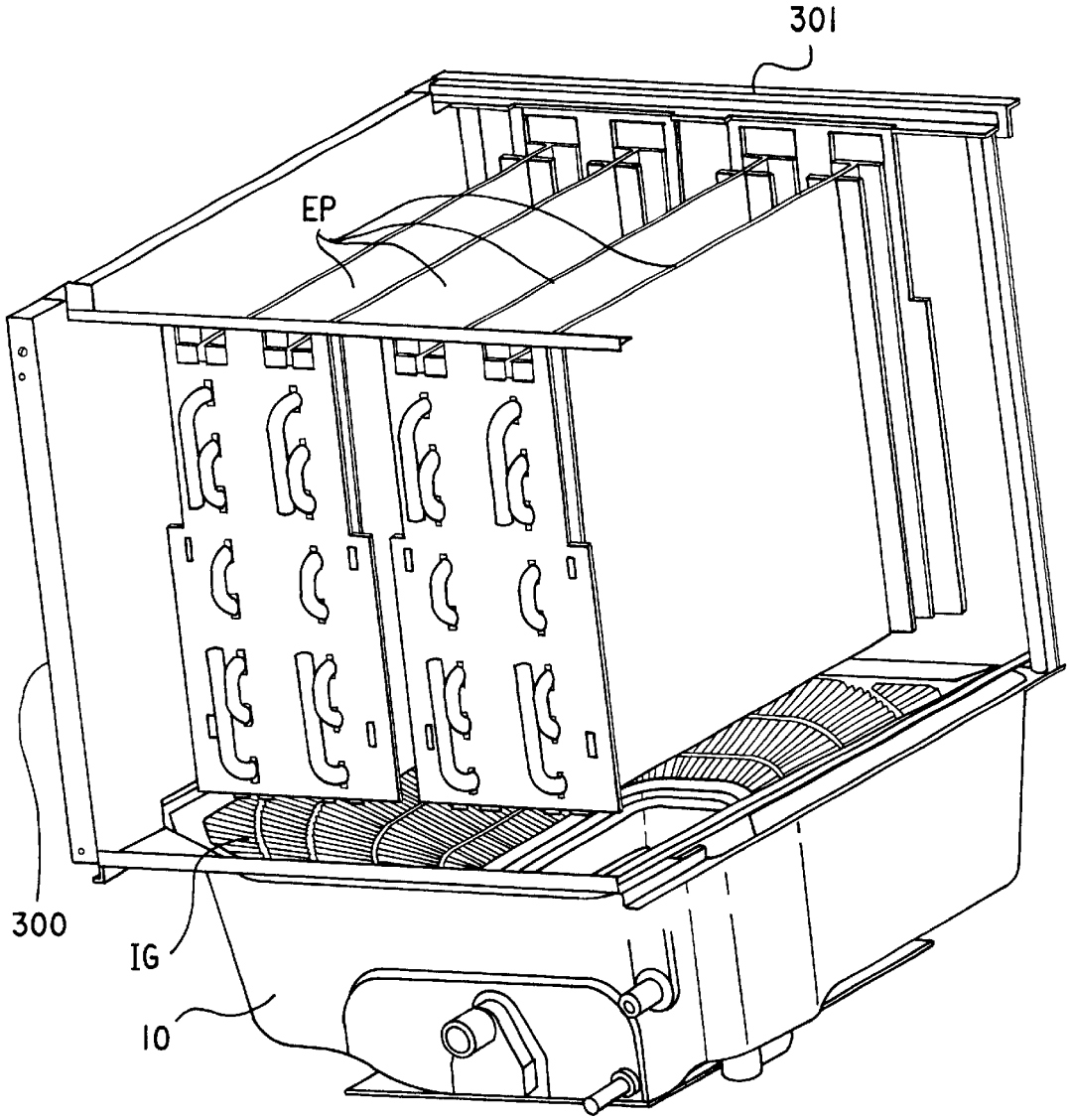
FIG. 1 is a perspective view of the water tank according to the preferred embodiment of this invention arranged within the ice making section of an ice making machine.

FIG. 1 illustrates a perspective view of the water tank 10 arranged within the ice making section of an ice making machine according to the preferred embodiment of this invention. The water tank 10 is positioned beneath an ice guide IG within the ice making section of the ice making machine (not shown). The water tank 10 and ice guide IG are both located above an ice bin 100 (See FIG. 2) where the harvested ice I is directed and the dashed 200 indicates a pile of the harvested ice.

Figure 2:
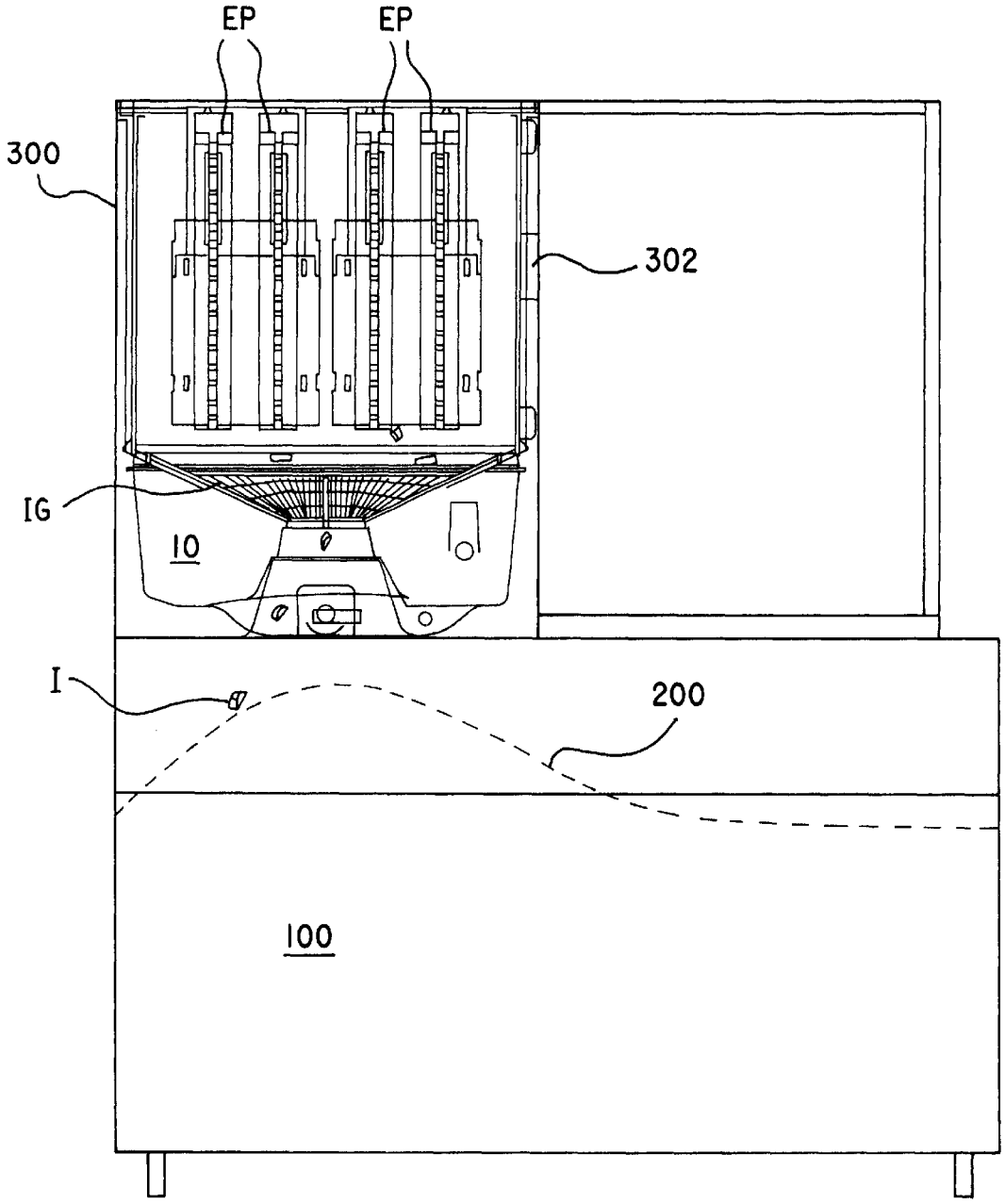
FIG. 2 is a schematic diagram of the arrangement of FIG. 1 positioned above an ice bin.

The water tank 10 and ice guide IG are disposed beneath at least one evaporator plate EP, FIGS. 1–2 providing four evaporator plates EP merely as an example. The evaporator plates EP are positioned above the ice guide IG and water tank 10 so that when the ice I is harvested in a conventional manner, the ice I falls off the evaporator plates EP and drops onto the ice guide IG, from where the ice I is guided into the bin 100.

Figure 3:
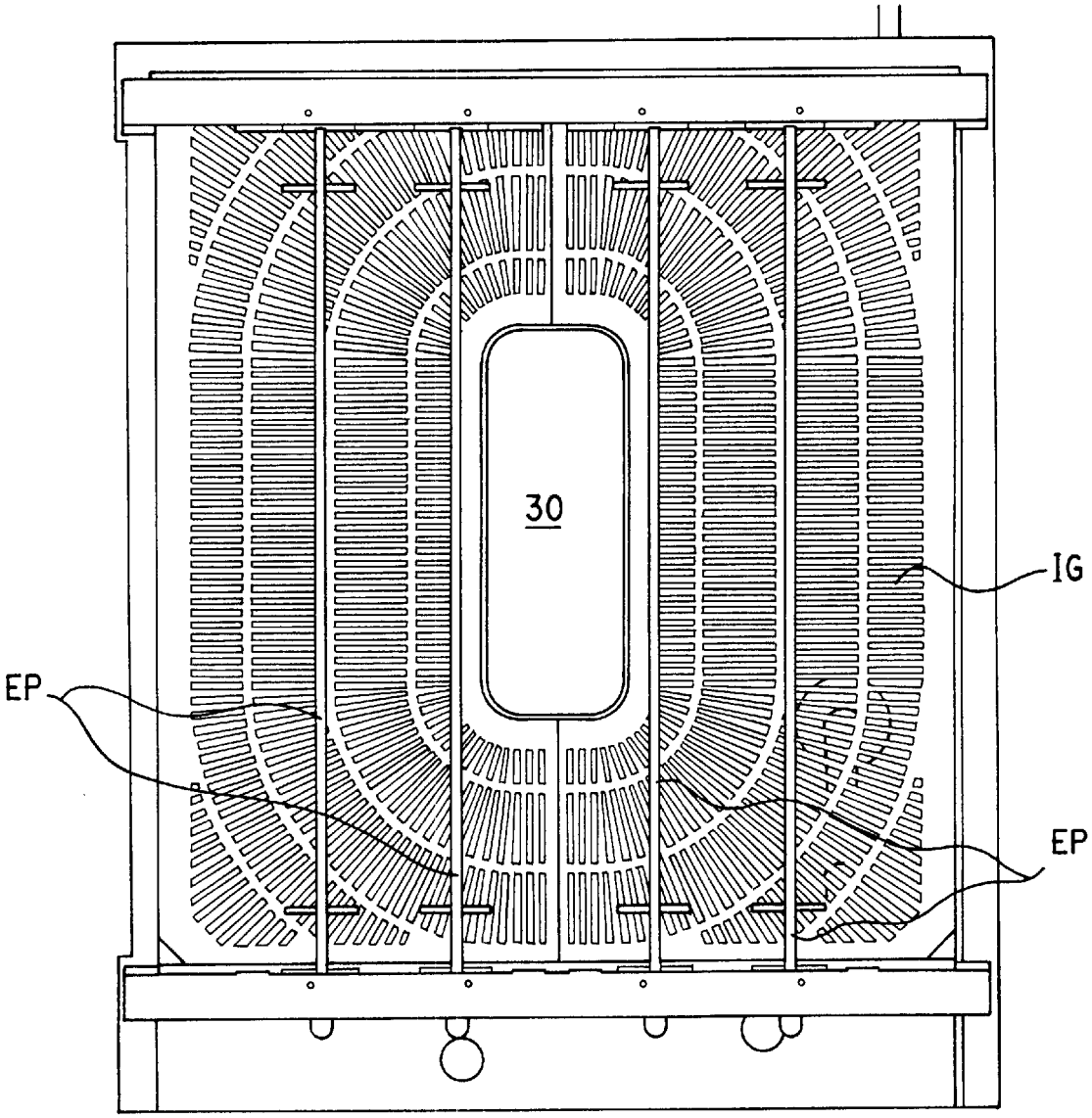
FIG. 3 is an overhead view of the arrangement in FIG. 1.

FIG. 3 is an overhead view of the assembly shown in FIG. 1. As can be seen, the four evaporator plates EP are positioned directly above the ice guide IG, which is snugly fit in the water tank 10. Accordingly, when the ice I is harvested from the evaporator plates EP, the falling ice I is directed by the ice guide IG into a rectangular aperture 30 defined by the water tank 10 which communicates with the ice bin 100 below.

Figure 4:
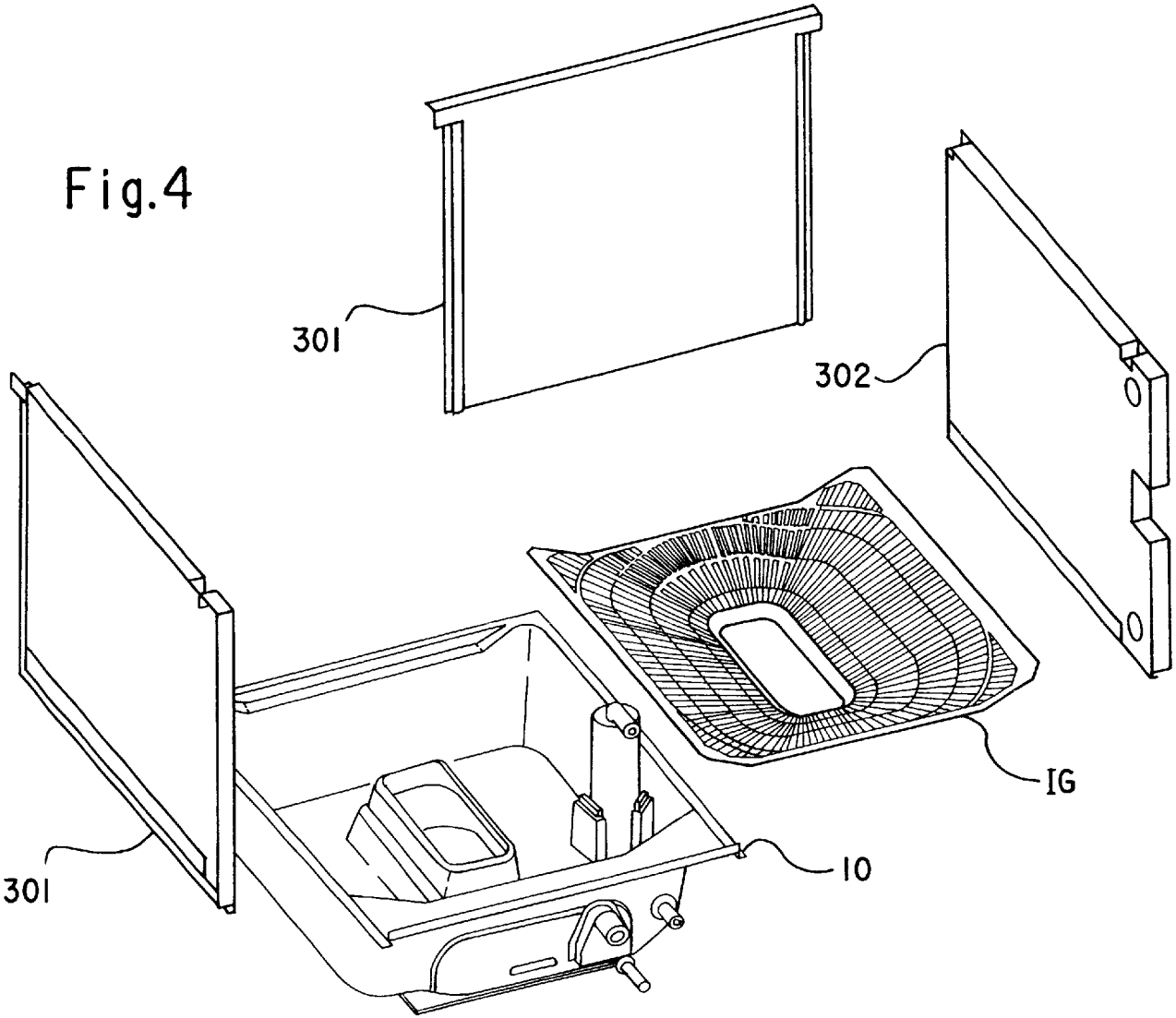
FIG. 4 is an exploded view of the arrangement of FIG. 1 without evaporator plates.

FIG. 4 is an exploded view of the arrangement shown in FIG. 1 with the evaporator plates EP not shown to simplify explanation. As can be seen, the ice guide IC is designed to snugly fit within the water tank 10. The snug fit assembly of the ice guide IG and water tank 10 is bound by the walls, 300, 301, and 302 of the ice making machine.

Figure 5:
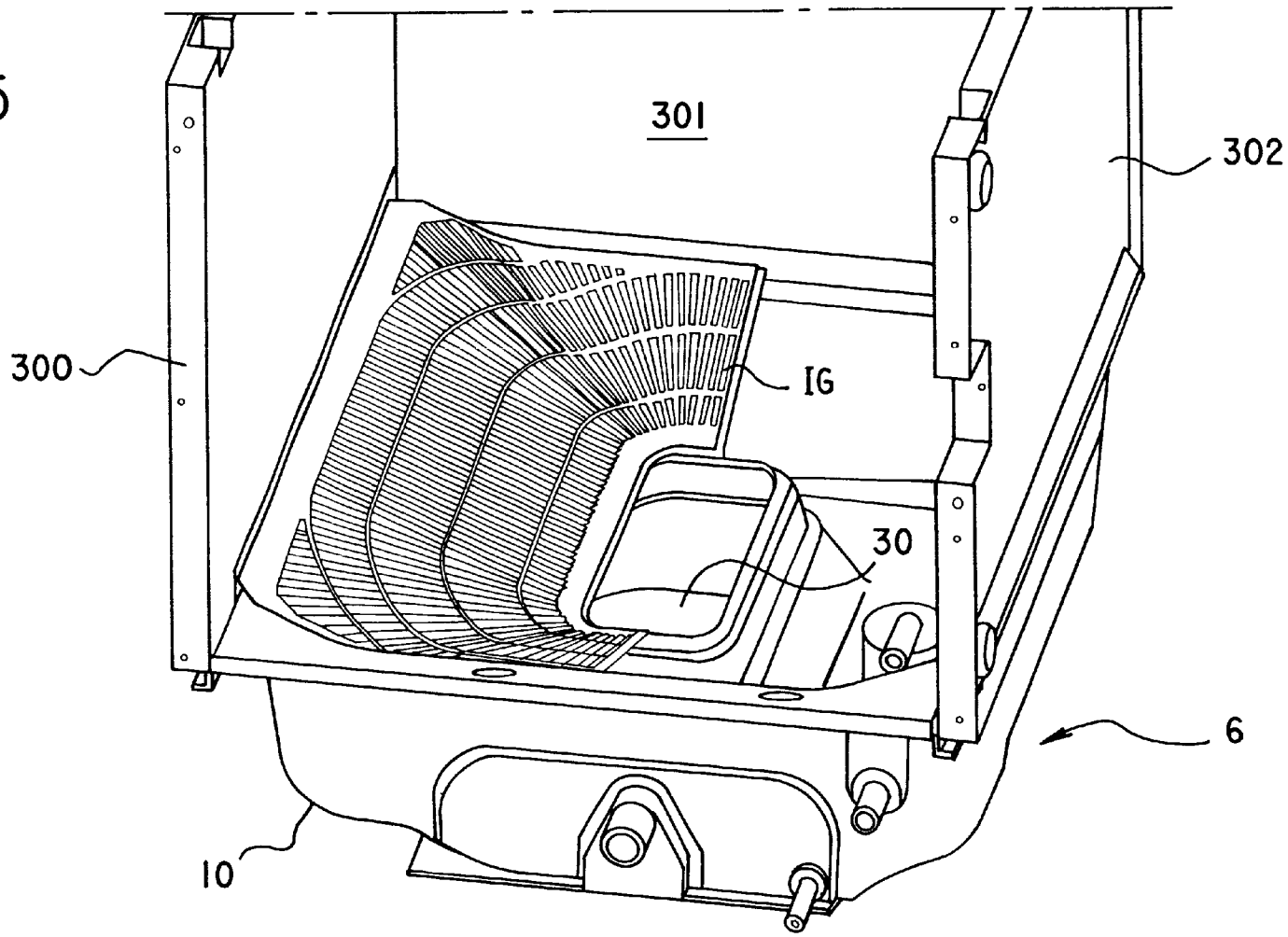
FIG. 5 is a perspective view of the water tank of FIG. 1 with half of the ice guide snugly fit therein.
Figure 6:
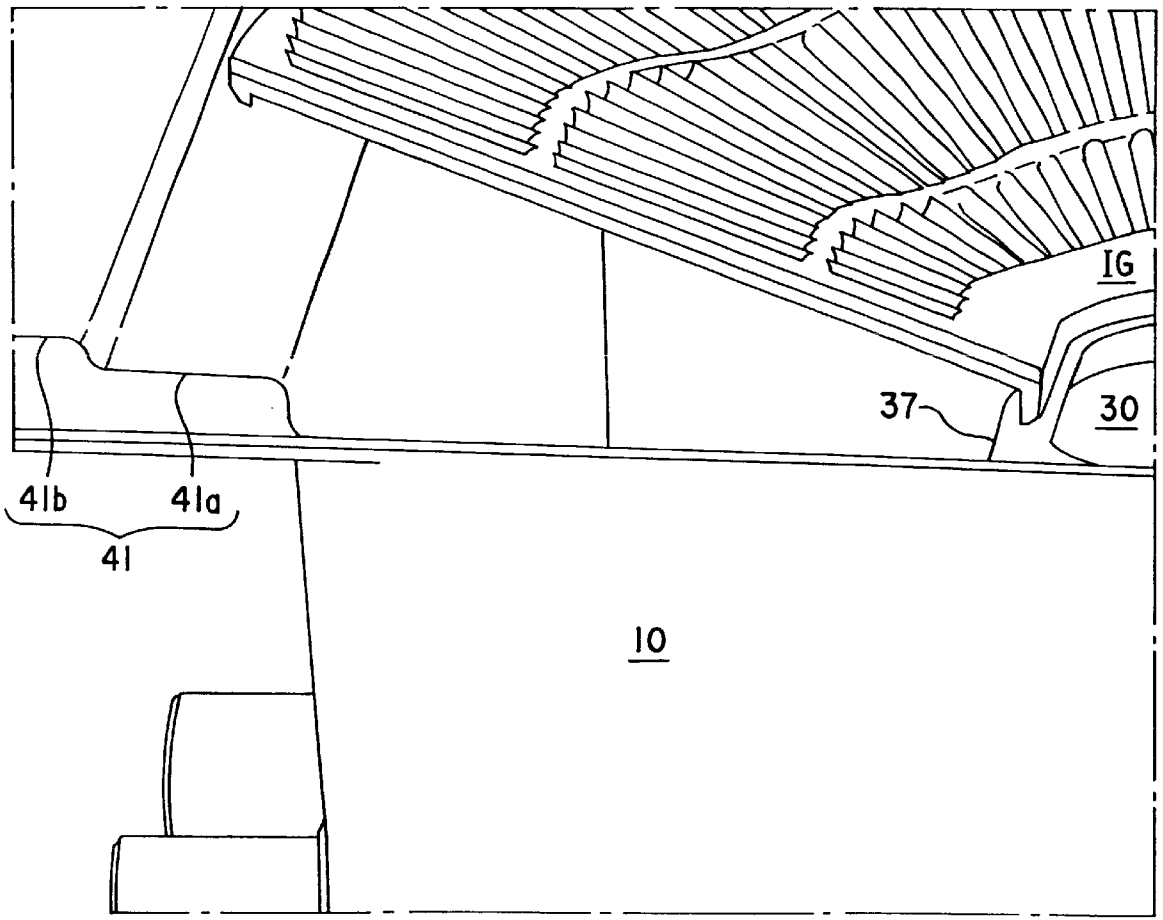
FIG. 6 is a close up of the ice guide snugly fitting within the water tank shown in FIG. 5.

FIG. 5 is a perspective view of the water tank 10 surrounded by the walls 300–302 of the ice making machine with half the ice guide IG to more clearly illustrate the relationship between the water tank 10 and ice guide IG. FIG. 6 is a close up of the ice guide IG snugly fitting within the water tank 10 from the direction indicated by arrow 6 in FIG. 5. A front wall 21 of the water tank 10 has a funnel edge 41.

The funnel edge 41 includes a step portion 41*a* and a slide portion 41*b*. A slanted lip 37 of the water tank 10 defines the rectangular aperture 30 through which the ice I is directed. The ice guide IG is snugly fit between the transition area of the slide portion 41*b* and step portion 41*a* and the slanted lip 37 of the water tank 10 and slopes in a downward direction from the transition area to the slanted lip. The end of the ice guide IG resting on the slanted lip 37 of the water tank 10 is directed toward the slanted lip 37 so that any water dripping from the evaporator plates EP or water formed from melted ice will travel along the downward slope of the ice guide IG and fall between the end of the ice guide IG and slanted lip 37. Then, the water will be directed to a base 25 of the water tank 10 by the slanted lip 37 rather than fall into the ice bin 100 where it would melt the ice I stored therein. The design of the slanted lip 37 also prevents such water from sitting in a single location and stagnating, which would create health hazards as well as an unpleasant odor.

Figure 7:
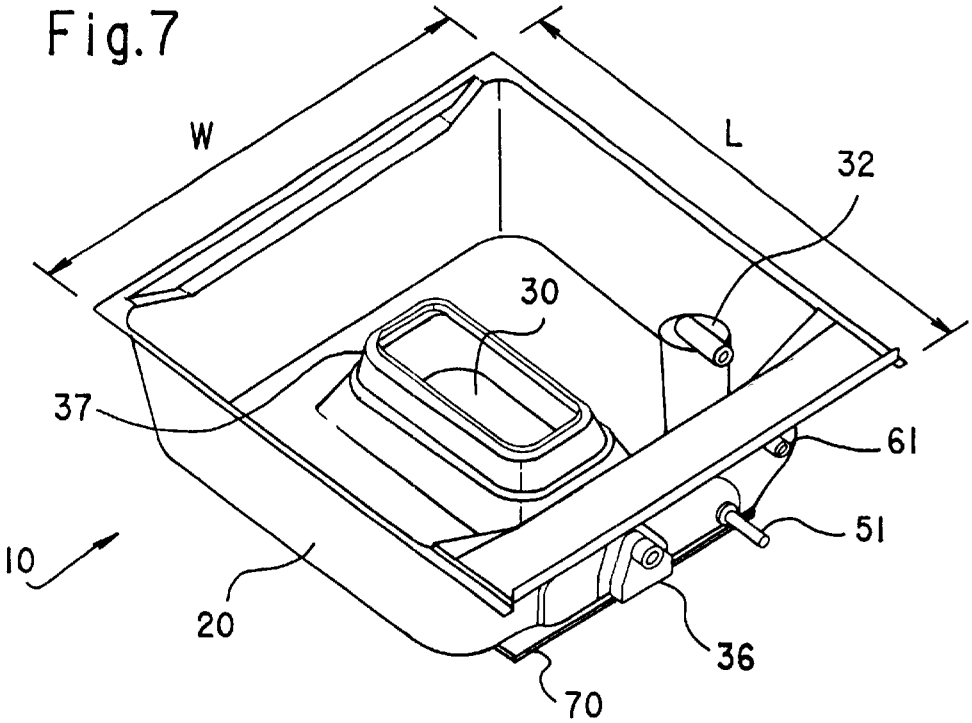
FIG. 7 is a perspective view of the water tank according to a preferred embodiment of the invention.

FIG. 7 illustrates a perspective view of the water tank 10 according to the preferred embodiment. The water tank 10 is manufactured from any suitable material, such as, for example only, Acrylonitrile Butadiene Styrene (ABS) or other National Sanitation Foundation (NSF) approved plastic that can withstand a thermal forming process. The dimensions of the water tank 10 are such that the width W and length L completely span a bottom portion of the ice making section of an ice making machine so the tank 10 is used as the base of the ice making section.

Figure 8:
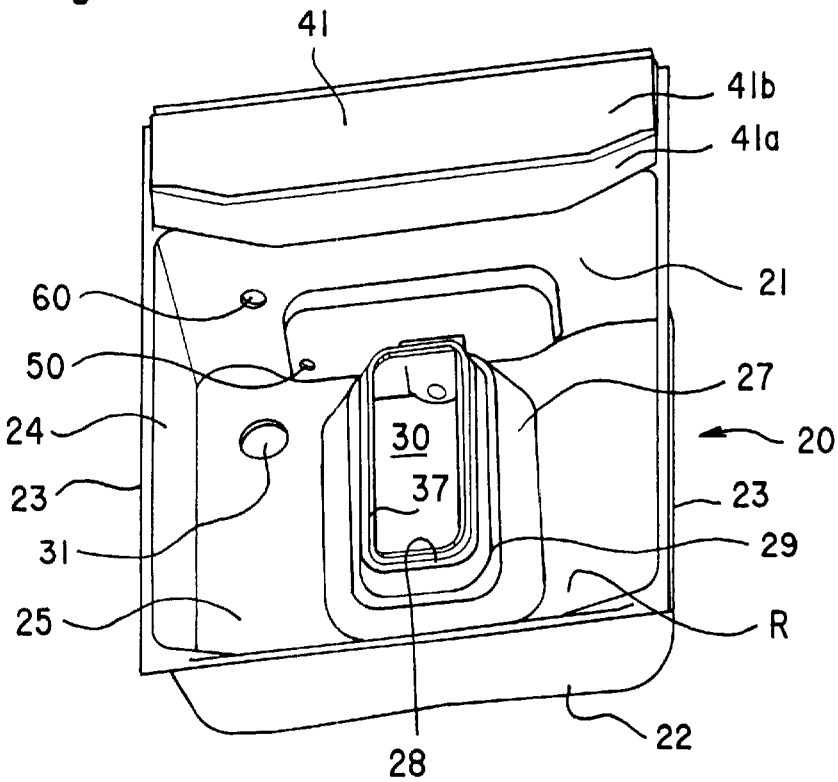
FIG. 8 is a rear view of the water tank illustrated in FIG. 7 with nested tub and hat portions.

FIG. 8 is a perspective rear view of the water tank 10. The water tank 10 includes a tub portion 20 and a support hat portion 70. The tub portion 20 includes a front wall 21 opposite a back wall 22 and a left side wall 23 parallel to a right side wall 24. The front, back and side walls 21–24 all emanate upward from the base 25 to define a water retention area R.

Figure 9:
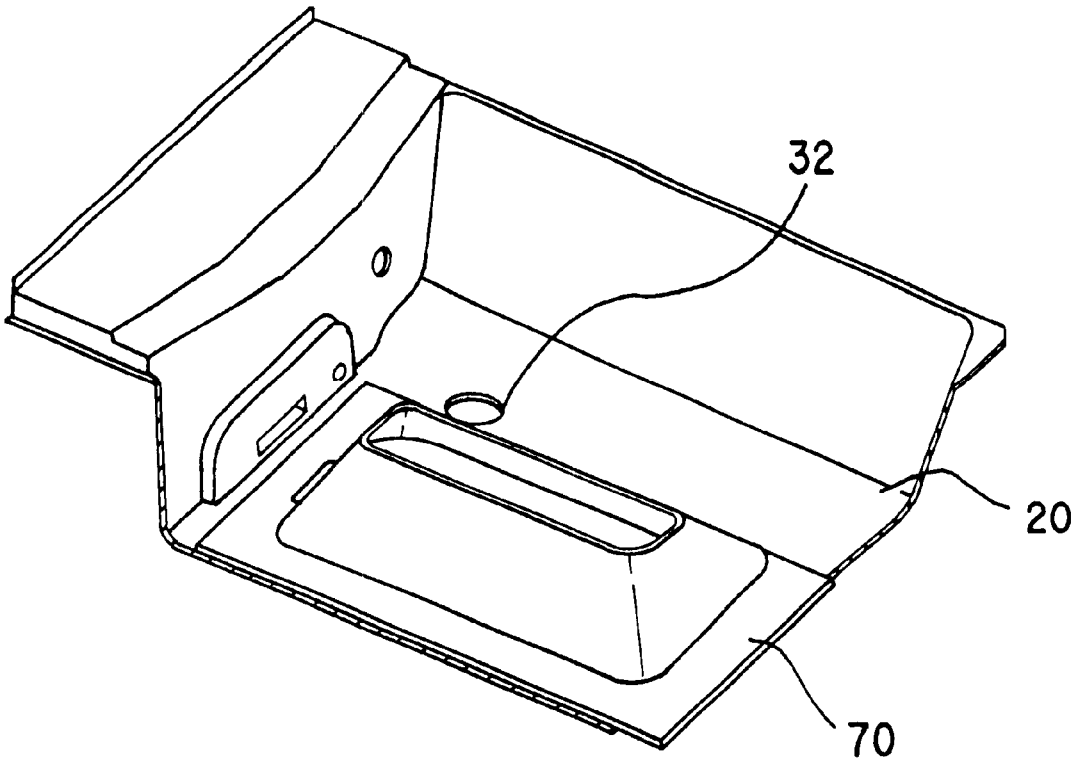
FIG. 9 is a bottom view of the water tank illustrated in FIG. 8.

The base 25 includes an outlet pipe orifice 31 and a support mound 26 projecting therefrom. The outlet pipe orifice 31 is designed to receive an overflow pipe 32 (FIG. 7) on a tank side of the orifice 31 and an outlet pipe 31 (FIG. 9) on a bottom side of the orifice 31. The overflow pipe 32 and outlet pipe 31 are used to ensure the water tank 10 does not overflow.

Also, the front wall 22 includes a float switch orifice 50 and a pump out orifice 60 (FIG. 8). The float switch orifice 50 is designed to house a float switch monitor 51 that checks the water level within the tank 10 and senses when the ice manufacturing cycle should start and/or stop. Furthermore, the pump out orifice 60 is designed to receive a pump out drain 61 that pumps water out of the water tank 10 when the tank is being cleaned (FIG. 7).

Figure 12:
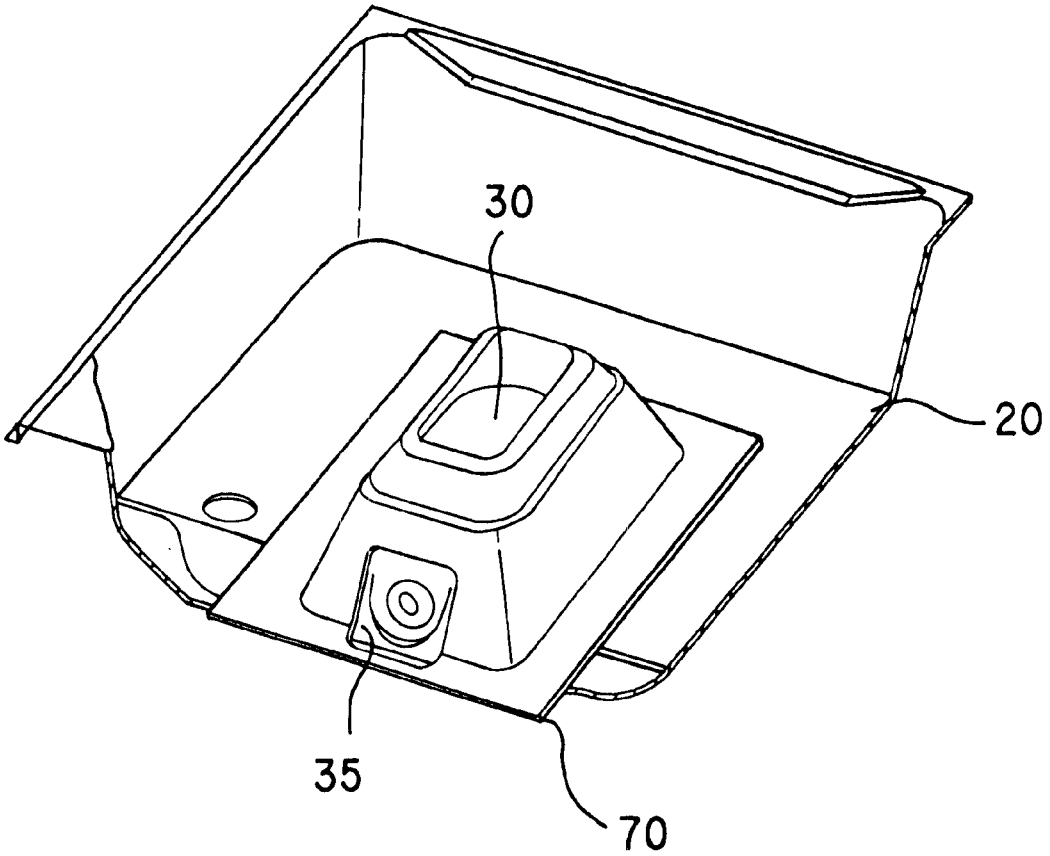
FIG. 12 is a bottom rear view of the water tank illustrated in FIG. 9.

As shown in FIGS. 8 and 10, the support mound 26 includes a first section 27 and a second section 28 extending from the first section 27. The first section 27 is wider than the second section 28 such that a ledge 29 is formed therebetween. Additionally, the second section 28 includes a rectangular aperture 30 which defines a passage for the manufactured ice to pass through as the ice is guided to the storage bin 100 beneath the water tank 10. The slanted lip 37 of the second section 28 is used to support the ice guide IG in a manner to be described later. A front wall 33 of the first section 27 includes a suction pipe housing orifice 34 designed to receive the housing 35 (FIG. 12) of a suction pipe 36 (FIG. 7) used to connect a pump (not shown) that pumps water to the evaporator plates.

The back wall 22, left side wall 23, and right side wall 24 each have an edge 38, 39, and 40, respectively, extending substantially parallel to the base 25. The edge 38 of the back wall 22 also includes a step portion 68 formed therein. Also, the front wall 22 has a funnel edge 41 formed thereon. The funnel edge 41 includes a step portion 41*a* and a slide portion 41*b*. The step portion 68 of the back wall 22 and the step portion 41*a* of the funnel edge 41, in conjunction with the lip 37 of the second section 28, are used to support the ice guide IG thereon. Accordingly, the water tank 10 is provided with an integral support system to securely maintain an ice guide, reduce the amount of stress the water tank 10 endures from the falling ice and provide the ice guide with a manner of snugly fitting within the water tank 10.

The slide portion 41*b* is used to guide any falling ice that does not land on the ice guide back onto the ice guide. Furthermore, the slide portion 41*b* can be used by a maintenance worker to grab the water tank before slidingly removing the tank 10 from the ice making machine as well as a support surface to hold onto while cleaning or otherwise performing maintenance on the water tank 10.

Figure 13:
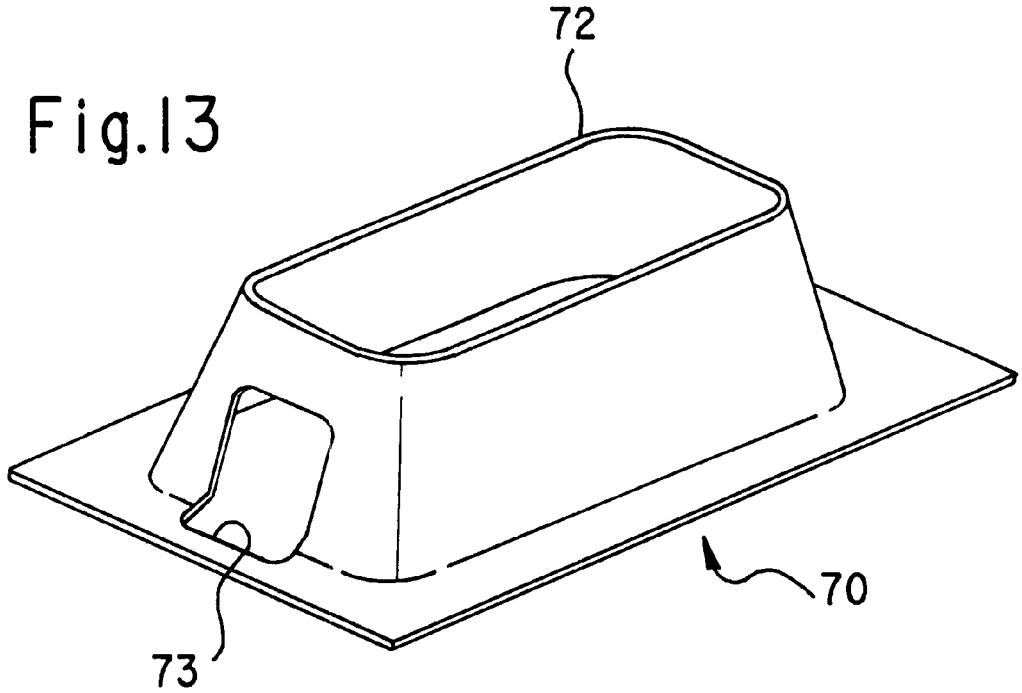
FIGS. 13–14 are bottom and top perspective views of the support hat portion of the water tank.
Figure 14:
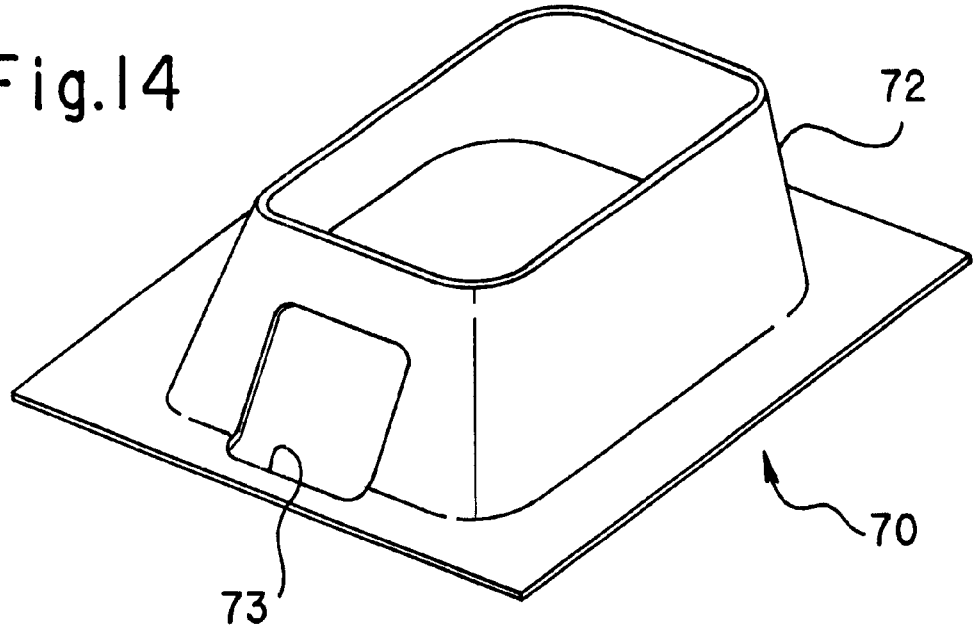

FIGS. 13–14 illustrate bottom and top perspective views of the support hat portion 70, respectively. The support hat portion 70 has a frusto-conical design with a support mound 72 no wider than the first section 27 of the support mound 26 and a drain housing orifice 73 that corresponds with the drain housing orifice 34 of the tub portion 20. Accordingly, when the support hat portion 70 is inserted, from a bottom side, into the tub portion 20, the support mound 72 of the support hat portion 70 nests with the first section of the support mound 26 of the tub portion 20 (see FIGS. 7, 9 and 12). This nesting feature provides the first and second section 27 and 28 of the support mound 26 with superior rigidity and stability at a critical point where the ice guide is centrally supported by the water tank 10. Therefore, when the tub and support hat portions 20 and 70 are nested, the resulting water tank 10 has a simple design that is easy to manufacture, requires fewer molds, is easy to clean, and provides an integral support system that securely maintains the ice guide thereon, thereby reducing the amount of stress the water tank endures from the falling ice, and provide the ice guide with a manner of snugly fitting within the water tank.

While the invention has been described in conjunction with a specific embodiment thereof, it is evident that many alternatives, modifications and variations may be apparent to those skilled in the art. Accordingly, the specific embodiment of the invention as set forth herein is intended to be illustrative, not limiting. Various changes may be made without departing from the spirit and scope of the invention as set forth in the following claims.

What is claimed is:

1. A water tank for positioning beneath an ice guide in an ice making section of a machine that manufactures ice, the water tank comprising:

a support hat portion having a frusto-conical design and support mound;

a tub portion having a support mound, said tub support mound including a first section, a second section extending from said first section, and a ledge between said first and second sections, said first section having a width larger than said second section to form said ledge and said second section having a rectangular aperture defined therein that permits the manufactured ice to pass therethrough, wherein said support hat support mound has a width no greater than said width of said first section; and an integral support system including said support hat nestingly engaging said tub portion from a bottom of said tub portion to provide a central support for the ice guide.

2. The water tank according to claim 1, wherein said support hat support mound further includes a rectangular aperture corresponding with said tub portion rectangular aperture.

3. The water tank according to claim 1, wherein said integral support system further comprises a lip positioned at a top of said second section.

4. The water tank according to claim 1, wherein said tub portion includes a front wall opposite to a back wall and a left side wall parallel to a right side wall, said front, back, right side and left side walls each emanating from a base of said tub portion to define a water retention area that retains water distributed by the ice making section.

5. The water tank according to claim 4, wherein said base includes an outlet pipe orifice and said tub portion support mound projects from a central portion of said base, said outlet pipe orifice is designed to receive an overflow pipe on a tank side of said outlet pipe orifice and an outlet pipe on a bottom side of said outlet pipe orifice, wherein said overflow pipe and said outlet pipe discharge water such that said water tank does not overflow.

6. The water tank according to claim 4, wherein said front wall of said tub portion includes a float switch orifice designed to receive a float switch monitor that monitors a water level within the water tank and a pump out orifice that receives a pump out drain to pump out water in the water tank when the water tank is being cleaned.

7. The water tank according to claim 4, wherein said back wall, said left side wall, and said right side wall each have an edge extending substantially parallel to said base.

8. The water tank according to claim 7, wherein said back wall further comprises a step portion formed therein and said front wall has a funnel edge.

9. The water tank according to claim 8, wherein said funnel edge includes a step portion and a slide portion, said integral support system further includes said step portions of said funnel edge and said back wall and a lip positioned at a top of said second section.

10. The water tank according to claim 1, wherein said water tank is manufactured from either one of Acrylonitrile Butadiene Styrene or National Sanitation Foundation approved thermal formable plastic.

11. The water tank according to claim 1, wherein the tank includes a width and length that completely span a bottom portion of the ice making section.

* * * * *